US007665926B2

(12) United States Patent
Cheng

(10) Patent No.: US 7,665,926 B2
(45) Date of Patent: Feb. 23, 2010

(54) RING MECHANISM WITH SPRING BIASED TRAVEL BAR

(75) Inventor: Ho Ping Cheng, Hong Kong (CN)

(73) Assignee: World Wide Stationery Mfg. Co., Ltd., Kwai Chung, New Territory (HK)

( * ) Notice: Subject to any disclaimer, the term of this patent is extended or adjusted under 35 U.S.C. 154(b) by 433 days.

(21) Appl. No.: 11/157,622

(22) Filed: Jun. 21, 2005

(65) Prior Publication Data

US 2006/0251468 A1 Nov. 9, 2006

Related U.S. Application Data

(60) Provisional application No. 60/678,394, filed on May 6, 2005.

(51) Int. Cl.
*B42F 3/04* (2006.01)
*B42F 13/20* (2006.01)

(52) U.S. Cl. ..... 402/38; 402/35; 402/36; 402/37

(58) Field of Classification Search ..... 402/19, 402/20, 23, 26, 31–42, 70, 73, 76, 77
See application file for complete search history.

(56) References Cited

U.S. PATENT DOCUMENTS 566,717 A 8/1896 Krah
651,254 A 6/1900 Krah
683,019 A 9/1901 Buchanan
790,382 A 5/1905 McBride
854,074 A 5/1907 Bryant
857,377 A 6/1907 Baker
974,831 A 11/1910 Scherzinger
1,011,391 A 12/1911 Sturgis
1,163,179 A 12/1915 Schade (Continued)

FOREIGN PATENT DOCUMENTS

DE 10119121 A1 10/2001

(Continued)

OTHER PUBLICATIONS

Kokuyo Lock Ring Mechanism with description, two instruction sheets, and nine photographs, undated but admitted as prior art, 12 pgs.

(Continued)

*Primary Examiner*—Dana Ross
*Assistant Examiner*—Kyle Grabowski
(74) *Attorney, Agent, or Firm*—Senniger Powers LLP

(57) ABSTRACT

A ring mechanism for retaining loose-leaf pages comprises a housing, hinge plates, and ring members. The housing supports the hinge plates for pivoting motion relative to the housing to open and close ring members mounted thereon. The mechanism comprises a thin, flat travel bar below the hinge plates arranged in a vertical orientation. The travel bar is supported by coil springs in a position where the travel bar is adjacent a bottom surface of the hinge plates. The travel bar moves relative to the hinge plates between a position blocking the hinge plates against pivoting when the ring members are closed and a position allowing the hinge plates to pivot when it is desired to open the ring members.

15 Claims, 12 Drawing Sheets

U.S. PATENT DOCUMENTS

| | | | | | |
|---|---|---|---|---|---|
| 1,168,260 | A | * | 1/1916 | Albrecht | 402/40 |
| 1,398,034 | A | | 11/1921 | Mero | |
| 1,398,388 | A | | 11/1921 | Murphy | |
| 1,733,548 | A | | 10/1929 | Martin | |
| 1,733,894 | A | | 10/1929 | Martin | |
| 1,787,957 | A | | 1/1931 | Schade | |
| 1,822,669 | A | | 9/1931 | Schade | |
| 1,857,291 | A | | 5/1932 | Trussell | |
| 1,953,981 | A | | 4/1934 | Trussell | |
| 1,991,362 | A | | 2/1935 | Krag | |
| 1,996,463 | A | | 4/1935 | Dawson | |
| 2,004,570 | A | | 6/1935 | Dawson | |
| 2,013,416 | A | | 9/1935 | McClure | |
| 2,024,461 | A | | 12/1935 | Lotter | |
| 2,067,846 | A | * | 1/1937 | Cooper | 402/62 |
| 2,075,766 | A | | 3/1937 | Rand | |
| 2,089,211 | A | | 8/1937 | Krag | |
| 2,096,944 | A | | 10/1937 | Unger | |
| 2,103,307 | A | | 12/1937 | Unger | |
| 2,105,235 | A | | 1/1938 | Schade | |
| 2,158,056 | A | | 5/1939 | Cruzan | |
| 2,179,627 | A | | 11/1939 | Handler | |
| 2,204,918 | A | | 6/1940 | Trussell | |
| 2,218,105 | A | | 10/1940 | Griffin | |
| 2,236,321 | A | | 3/1941 | Ostrander | |
| 2,239,062 | A | | 4/1941 | Tallmadge | |
| 2,239,121 | A | | 4/1941 | Louis | |
| 2,251,878 | A | | 8/1941 | Hanna | |
| 2,252,422 | A | * | 8/1941 | Unger | 402/44 |
| 2,260,929 | A | | 10/1941 | Bloore | |
| 2,288,189 | A | | 6/1942 | Guinane | |
| 2,304,716 | A | | 12/1942 | Supin | |
| 2,311,492 | A | | 2/1943 | Unger | |
| 2,322,595 | A | | 6/1943 | Schade | |
| 2,338,011 | A | | 12/1943 | Schade | |
| 2,421,799 | A | | 6/1947 | Martin | |
| 2,528,866 | A | | 11/1950 | Dawson | |
| 2,543,866 | A | | 3/1951 | Panfil | |
| 2,552,076 | A | | 5/1951 | Wedge | |
| 2,612,169 | A | | 9/1952 | Segal | |
| 2,789,561 | A | | 4/1957 | Bonn | |
| 2,865,377 | A | | 12/1958 | Schroer | |
| 2,871,711 | A | | 2/1959 | Stark | |
| 2,891,553 | A | | 6/1959 | Acton | |
| 2,894,513 | A | | 7/1959 | Gempe | |
| 3,077,888 | A | | 2/1963 | Thieme | |
| 3,098,489 | A | | 7/1963 | Vernon | |
| 3,098,490 | A | | 7/1963 | Wance | |
| 3,101,719 | A | | 8/1963 | Vernon | |
| 3,104,667 | A | | 9/1963 | Mintz | |
| 3,149,636 | A | | 9/1964 | Rankin | |
| 3,190,293 | A | | 6/1965 | Schneider | |
| 3,205,894 | A | | 9/1965 | Rankin | |
| 3,205,895 | A | | 9/1965 | Johnson | |
| 3,255,759 | A | | 6/1966 | Dennis | |
| 3,348,550 | A | | 10/1967 | Wolf | |
| 3,718,402 | A | | 2/1973 | Schade | |
| 3,748,051 | A | | 7/1973 | Frank | |
| 3,884,586 | A | | 5/1975 | Michaelis | |
| 3,954,343 | A | | 5/1976 | Thomsen | |
| 3,993,374 | A | | 11/1976 | Schudy et al. | |
| 4,127,340 | A | | 11/1978 | Almgren | |
| 4,130,368 | A | | 12/1978 | Jacoby et al. | |
| 4,352,582 | A | | 10/1982 | Eliasson | |
| 4,486,112 | A | | 12/1984 | Cummins | |
| 4,522,526 | A | | 6/1985 | Lozfau | |
| 4,566,817 | A | | 1/1986 | Barrett, Jr. | |
| 4,571,108 | A | | 2/1986 | Vogl | |
| 4,696,595 | A | | 9/1987 | Pinkney | |
| 4,798,491 | A | | 1/1989 | Lassle | |
| 4,813,803 | A | | 3/1989 | Gross | |
| 4,815,882 | A | | 3/1989 | Ohminato | |
| 4,886,390 | A | | 12/1989 | Silence | |
| 4,919,557 | A | | 4/1990 | Podosek | |
| 5,067,840 | A | | 11/1991 | Cooper | |
| 5,116,157 | A | | 5/1992 | Gillum | |
| 5,135,323 | A | | 8/1992 | Pinheiro | |
| 5,180,247 | A | | 1/1993 | Yu | |
| 5,255,991 | A | | 10/1993 | Sparkes | |
| 5,286,128 | A | | 2/1994 | Gillum | |
| 5,332,327 | A | | 7/1994 | Gillum | |
| 5,346,325 | A | | 9/1994 | Yamanoi | |
| 5,354,142 | A | | 10/1994 | Yu | |
| 5,368,407 | A | | 11/1994 | Law | |
| 5,378,073 | A | | 1/1995 | Law | |
| 5,393,155 | A | | 2/1995 | Ng | |
| 5,393,156 | A | | 2/1995 | Mullin et al. | |
| 5,476,335 | A | | 12/1995 | Whaley | |
| 5,524,997 | A | | 6/1996 | von Rohrscheidt | |
| 5,577,852 | A | | 11/1996 | To | |
| 5,651,628 | A | | 7/1997 | Bankes | |
| 5,660,490 | A | | 8/1997 | Warrington | |
| 5,692,847 | A | | 12/1997 | Zane | |
| 5,692,848 | A | | 12/1997 | Wada | |
| 5,718,529 | A | | 2/1998 | Chan | |
| 5,782,569 | A | | 7/1998 | Mullin et al. | |
| 5,788,392 | A | | 8/1998 | Cheung | |
| 5,807,006 | A | | 9/1998 | Cheung | |
| 5,810,499 | A | | 9/1998 | Law | |
| 5,816,729 | A | | 10/1998 | Whaley | |
| 5,836,709 | A | | 11/1998 | Cheung | |
| 5,868,513 | A | | 2/1999 | Law | |
| 5,879,097 | A | | 3/1999 | Cheng | |
| 5,882,135 | A | | 3/1999 | Ko | |
| 5,895,164 | A | | 4/1999 | Wu | |
| 5,924,811 | A | | 7/1999 | To | |
| 5,957,611 | A | | 9/1999 | Whaley | |
| 5,975,785 | A | | 11/1999 | Chan | |
| 6,036,394 | A | * | 3/2000 | Cheng | 402/26 |
| 6,142,697 | A | | 11/2000 | Williams | |
| 6,146,042 | A | | 11/2000 | To et al. | |
| 6,155,737 | A | | 12/2000 | Whaley | |
| 6,203,229 | B1 | | 3/2001 | Coerver | |
| 6,206,601 | B1 | | 3/2001 | Ko | |
| 6,217,247 | B1 | | 4/2001 | Ng | |
| 6,270,279 | B1 | | 8/2001 | Whaley | |
| 6,276,862 | B1 | | 8/2001 | Snyder et al. | |
| 6,293,722 | B1 | | 9/2001 | Holbrook et al. | |
| 6,364,558 | B1 | | 4/2002 | To | |
| 6,371,678 | B1 | | 4/2002 | Chizmar | |
| 6,467,984 | B1 | | 10/2002 | To | |
| 6,474,897 | B1 | | 11/2002 | To | |
| 6,533,486 | B1 | | 3/2003 | To | |
| 6,749,357 | B2 | | 6/2004 | Cheng | |
| 6,758,621 | B2 | | 7/2004 | To | |
| 6,821,045 | B2 | | 11/2004 | Whaley | |
| 6,840,695 | B2 | | 1/2005 | Horn | |
| 6,916,134 | B2 | | 7/2005 | Wong | |
| 7,296,946 | B2 | | 11/2007 | Cheng | |
| 2002/0122687 | A1 | * | 9/2002 | Horn | 402/16 |
| 2003/0044221 | A1 | | 3/2003 | To | |
| 2003/0103797 | A1 | | 6/2003 | Cheng | |
| 2003/0103798 | A1 | * | 6/2003 | Cheng et al. | 402/73 |
| 2003/0123923 | A1 | * | 7/2003 | Koike et al. | 402/19 |
| 2005/0013654 | A1 | | 1/2005 | Cheng et al. | |
| 2005/0201817 | A1 | | 9/2005 | Cheng | |
| 2005/0201818 | A1 | | 9/2005 | Cheng | |
| 2005/0201819 | A1 | | 9/2005 | Cheng | |
| 2005/0201820 | A1 | | 9/2005 | Ng | |
| 2005/0207826 | A1 | | 9/2005 | Cheng | |
| 2005/0214064 | A1 | | 9/2005 | Ng | |
| 2005/0232689 | A1 | | 10/2005 | Cheng | |
| 2006/0008318 | A1 | | 1/2006 | Ng | |
| 2006/0056906 | A1 | * | 3/2006 | Horn | 402/31 |

| | | | | |
|---|---|---|---|---|
| 2006/0088365 | A1 | 4/2006 | Whaley | |
| 2006/0147253 | A1 | 7/2006 | Cheng | |
| 2006/0147254 | A1 | 7/2006 | Cheng | |
| 2006/0147255 | A1 | 7/2006 | Cheng | |
| 2006/0153628 | A1 | 7/2006 | Tanaka | |
| 2006/0153629 | A1 | 7/2006 | Cheng | |
| 2006/0216107 | A1 | 9/2006 | Lin | |
| 2006/0228164 | A1* | 10/2006 | Horn | 402/31 |
| 2006/0251467 | A1 | 11/2006 | Cheng | |
| 2007/0086836 | A1 | 4/2007 | Cheng | |

FOREIGN PATENT DOCUMENTS

| | | | |
|---|---|---|---|
| EP | 1316438 | A1 | 6/2003 |
| EP | 1323545 | A2 | 7/2003 |
| EP | 1431065 | A2 | 6/2004 |
| FR | 1 336 765 | | 9/1963 |
| FR | 1 346 864 | A | 12/1963 |
| FR | 2221924 | | 10/1974 |
| FR | 2 238 332 | A | 2/1975 |
| GB | 868724 | | 5/1961 |
| GB | 906279 | | 9/1962 |
| GB | 952536 | | 3/1964 |
| GB | 2231536 | A | 11/1990 |
| GB | 2251215 | A | 7/1992 |
| GB | 2275023 | A | 8/1994 |
| GB | 2292343 | A | 2/1996 |
| GB | 2387815 | A | 10/2003 |
| JP | 5979379 | | 5/1984 |
| JP | 6118880 | | 2/1986 |
| JP | 01299095 | A | 12/1989 |
| JP | 2-34289 | U | 3/1990 |
| JP | 4120085 | | 10/1992 |
| JP | 2004098417 | A | 4/2004 |
| WO | 0119620 | A1 | 3/2001 |
| WO | WO 01/19620 | A1 | 3/2001 |
| WO | 0181099 | A1 | 11/2001 |

OTHER PUBLICATIONS

Office Action dated Apr. 20, 2007 from related U.S. Appl. No. 10/323,052 now issued as U.S. Patent No. 7,296,946, 12 pages—(see p. 4).

Office action issued Mar. 26, 2009 from related U.S. Appl. No. 11/208,951, 12 pgs.

* cited by examiner

RING MECHANISM WITH SPRING BIASED TRAVEL BAR

CROSS REFERENCE TO RELATED APPLICATION

This application claims the benefit of U.S. Provisional Application No. 60/678,394, filed May 6, 2005, and entitled a Travel Bar For Use With A Ring Binder Mechanism, the entire disclosure of which is hereby incorporated by reference.

BACKGROUND OF THE INVENTION

This invention relates generally to a ring mechanism for retaining loose-leaf pages and more particularly to an improved mechanism for opening and closing ring members and for locking closed ring members together.

A ring mechanism typically retains loose-leaf pages, such as hole-punched papers, in a file or notebook. A pair of hinge plates are supported within a housing in joined relation for loose pivoting motion relative to the housing. The housing is generally narrower than the joined hinge plates when they are in a coplanar position (180°). So as the hinge plates pivot through the coplanar position, they deform the housing and cause a spring force that urges them to pivot either upward or downward. Ring members mounted on the hinge plates move with the pivoting movement of the hinge plates. The ring members open when the hinge plates pivot upward and close when the hinge plates pivot downward.

Some ring mechanisms include structure such as, for example, control slides located between the housings and the hinge plates to lock the ring members together when they close. The control slides engage upper surfaces of the hinge plates and block the hinge plates from pivoting upward when it is desired to hold the closed ring members together. The control slides move to a position allowing the hinge plates to pivot freely when it is desired to open the ring members. These mechanisms can be difficult to make, however, because the control slides are generally installed within the housings before the hinge plates. Consequently, proper positioning of the control slides relative to the hinge plates can be difficult. Additionally, the control slides may have a complex shape to interact with the hinge plates. This can increase production costs of ring mechanisms incorporating these control slides.

Accordingly, it would be desirable to provide a ring mechanism that is easy to make and includes a simplified travel bar.

SUMMARY OF THE INVENTION

A ring mechanism for retaining loose-leaf pages generally comprises a housing, hinge plates, rings, and a travel bar. The housing has a longitudinal axis, a central top portion, and an open bottom generally opposed to the central top portion. The hinge plates each have an upper surface and a lower surface. They are supported by the housing for pivoting movement relative to the housing with an upper surface of each hinge plate facing the housing. The rings hold the loose-leaf pages. Each ring includes a first ring member and a second ring member. The first ring member is mounted on a first hinge plate and is moveable with the pivoting motion of the first hinge plate relative to the second ring member between a closed position and an open position. In the closed position, the two ring members form a substantially continuous, closed loop for allowing loose-leaf pages retained by the rings to be moved along the rings from one ring member to the other. In the open position, the two ring members form a discontinuous, open loop for adding or removing loose-leaf pages from the rings. The travel bar is thin and flat and is supported for movement between a locked position in which the hinge plates are locked from pivoting from the closed position to the open position and an unlocked position in which the hinge plates are free to pivot from the closed position to the open position. The travel bar includes a major surface lying generally in a plane parallel to or coincident with a plane including the longitudinal axis of the housing and intersecting the central top portion and open bottom of the housing.

In another aspect, the ring mechanism of the invention generally comprises a housing, hinge plates, rings, a travel bar, and a spring. The hinge plates each have an upper surface and a lower surface, and are supported by the housing for pivoting movement relative to the housing about a pivot axis with an upper surface of each hinge plate facing the housing. The rings are substantially the same as previously described. The travel bar is disposed generally below the hinge plates and is supported for movement between a locked position in which the travel bar blocks movement of the hinge plates from the closed position to the open position and an unlocked position in which the travel bar does not block movement of the hinge plates from the closed position to the open position. The spring supports the travel bar in a position adjacent a lower surface of at least one of the hinge plates.

In still another aspect, a method of making a ring mechanism for retaining loose-leaf pages generally comprises the steps of stamping a travel bar from a sheet of material and connecting the travel bar to the ring mechanism with a major surface of the travel bar lying generally in a plane parallel to or coincident with a plane including a longitudinal axis of the housing and intersecting a central top portion and open bottom of the housing.

Other features of the invention will be in part apparent and in part pointed out hereinafter.

BRIEF DESCRIPTION OF THE DRAWINGS

Corresponding reference characters indicate corresponding parts throughout the views of the drawings.

DETAILED DESCRIPTION

Figure 1:
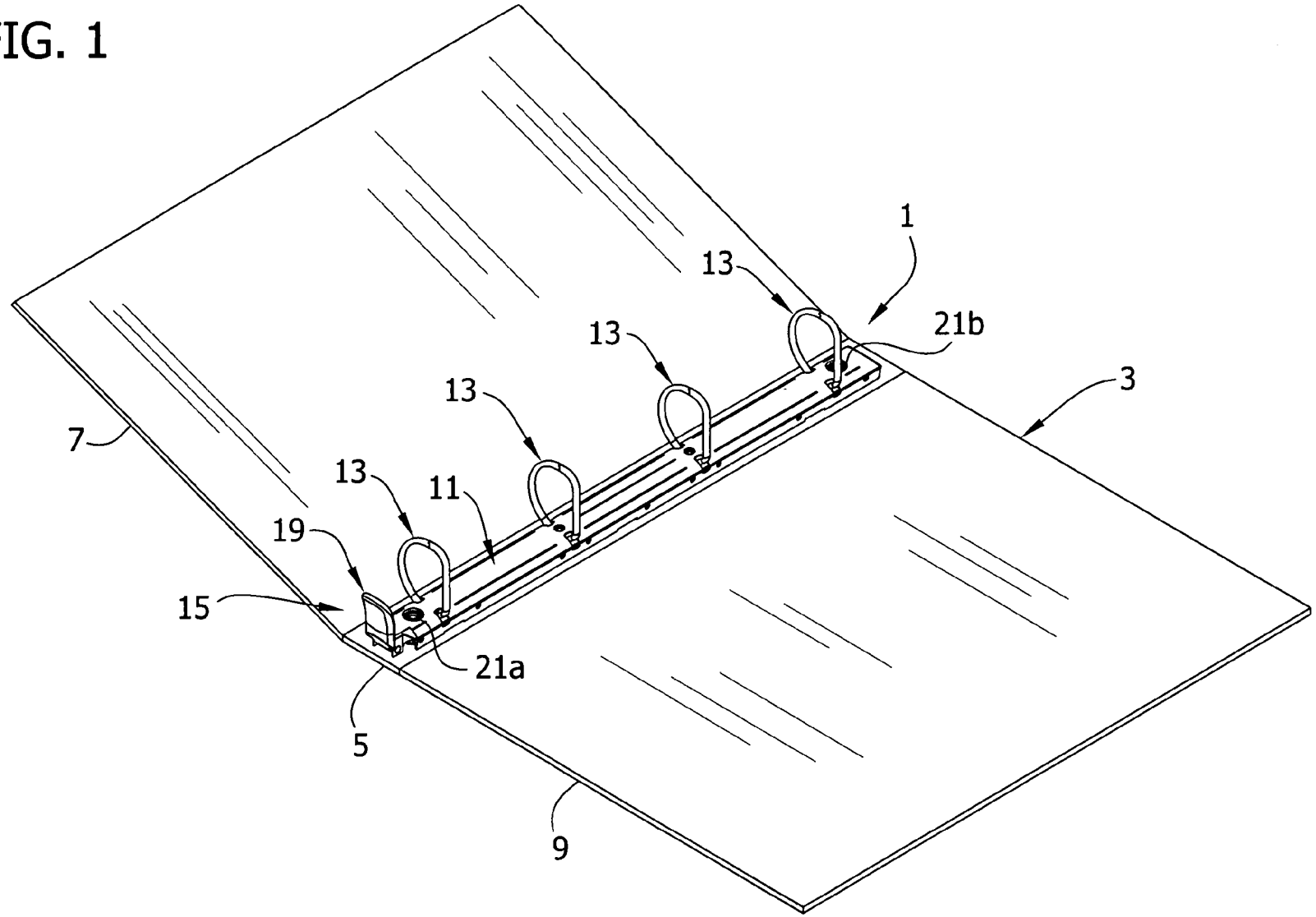
FIG. 1 is a perspective of a notebook incorporating a ring mechanism according to the invention.

Referring now to the drawings, FIGS. 1-11 show a ring mechanism of the invention generally at reference numeral 1.

The mechanism is shown in FIG. 1 mounted on a notebook, designated generally by reference numeral 3. In particular, it is shown mounted on a spine 5 of notebook 3 between a front cover 7 and a back cover 9. The front and back covers are hingedly attached to spine 5 for moving to selectively cover or expose loose-leaf pages (not shown in the drawings) retained by mechanism 1. A ring mechanism mounted on a surface other than a notebook, for example a file, does not depart from the scope of this invention.

The terms "forward" and "rearward" are used herein to describe relative orientation of components of ring mechanism 1. "Forward" refers to the right of the ring mechanism as viewed in FIG. 1 and "rearward" refers to the left of the ring mechanism. These terms do not limit the invention in any way.

As shown in FIG. 1, ring mechanism 1 generally includes an elongated housing, designated generally by reference numeral 11, four substantially identical rings, each designated generally by reference numeral 13, and a control structure, designated generally by reference numeral 15. Housing 11 supports rings 13 and control structure 15 for closing and opening operation of mechanism 1 to retain, add, or remove pages. This operation will be described in greater detail hereinafter.

Figure 2:
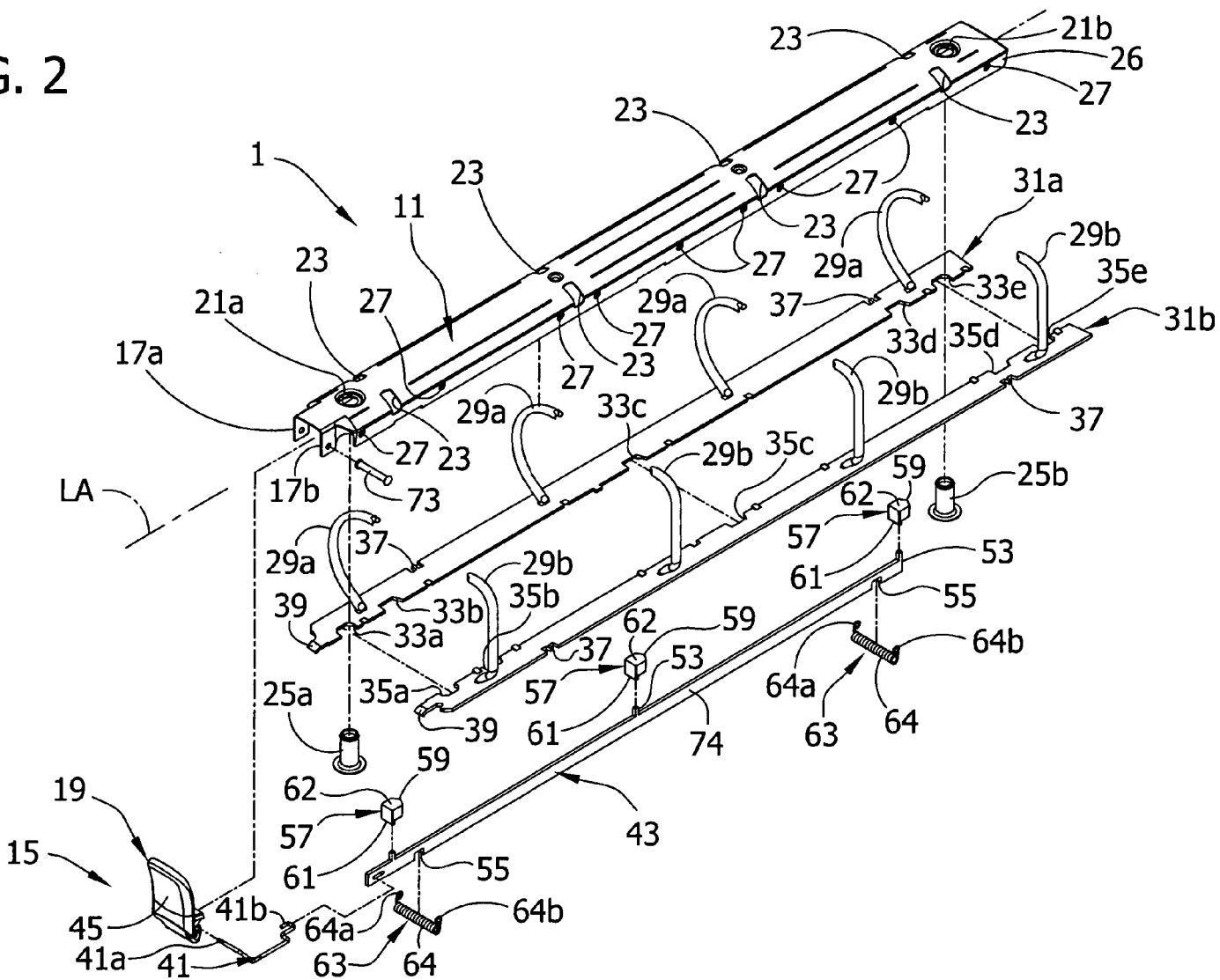
FIG. 2 is an exploded perspective of the ring mechanism.
Figure 10:
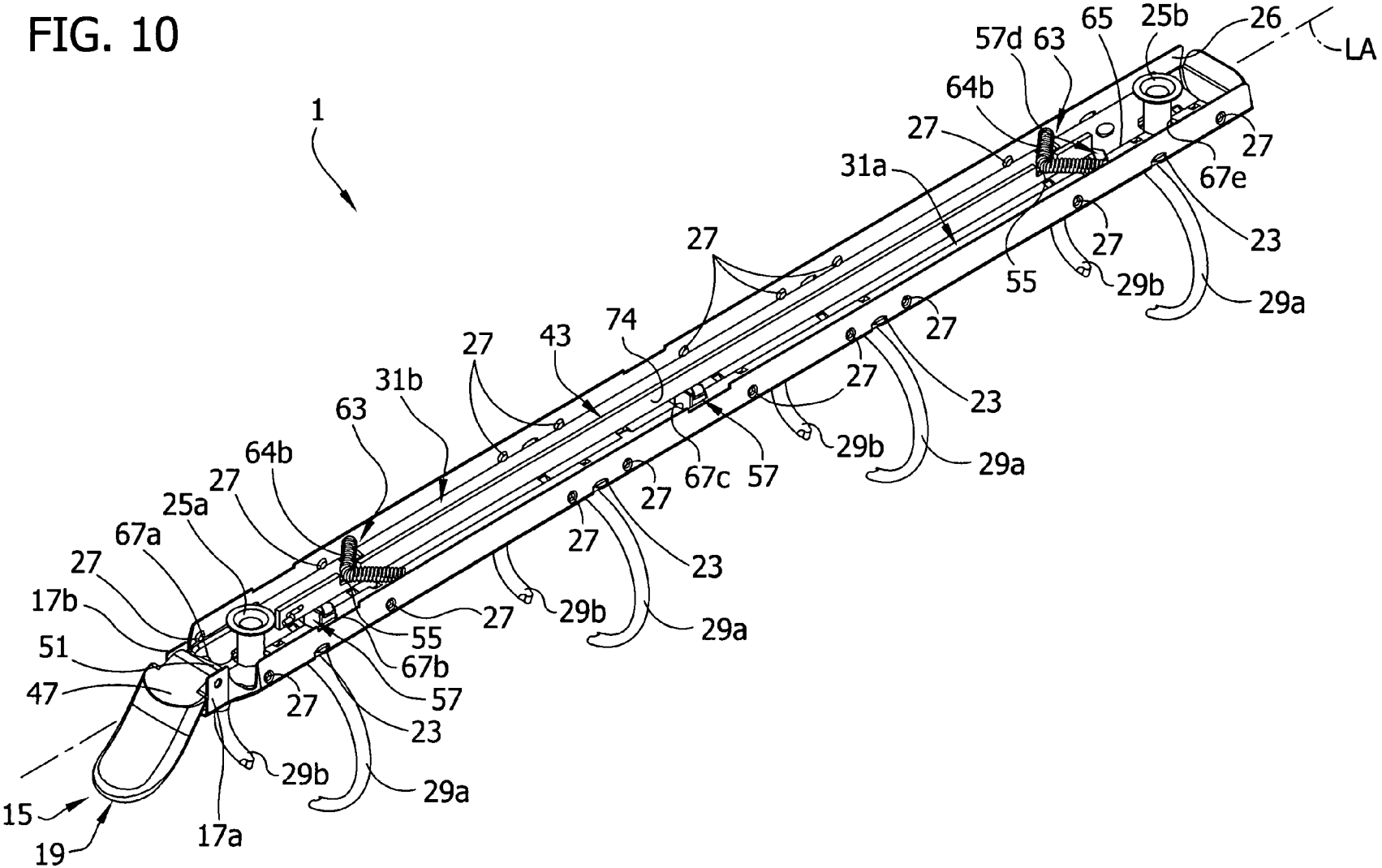
FIG. 10 is a bottom side perspective of the ring mechanism with ring members at an open position.

Referring to FIG. 2, components of ring mechanism 1 are shown in exploded perspective. Housing 11 is elongate with a uniform, generally arch-shaped cross section having a central top portion and an open bottom generally opposed to the central top portion. Housing 11 also includes opposing longitudinal ends. A rearward end (toward the left in FIG. 2) is generally open and a forward end (toward the right in FIG. 2) is generally closed (FIG. 10). The rearward end includes two similar mounting tabs 17a, 17b that project downward from a top surface of housing 11 and, as will be described, mount a lever, designated generally by reference numeral 19, on the housing (e.g., FIG. 1). Lever 19 and its operation will be described in further detail hereinafter. It is understood that a housing capable of mounting levers at both ends does not depart from the scope of this invention. Additionally, a ring mechanism having a housing with a different shape, including an irregular shape, or a housing integral with a file or notebook is within the scope of this invention.

Housing 11 includes multiple openings, including two mounting post openings 21*a*, 21*b* and eight ring openings (each designated by reference numeral 23). Mounting post openings 21*a*, 21*b* are located along the top surface of housing 11 toward opposite longitudinal ends. The openings receive and attach mounting posts 25*a*, 25*b*, respectively, to housing 11 for use in securing mechanism 1 to notebook spine 5 (FIG. 1). Ring openings 23 are oriented in four pairs along lateral surfaces of housing 11. The two openings of each pair are located on opposite lateral surfaces of housing 11, and the four pairs are spaced uniformly apart along the housing. Ring openings 23 allow rings 13 to move relative to housing 11 to open and close during operation of ring mechanism 1.

Figure 7:
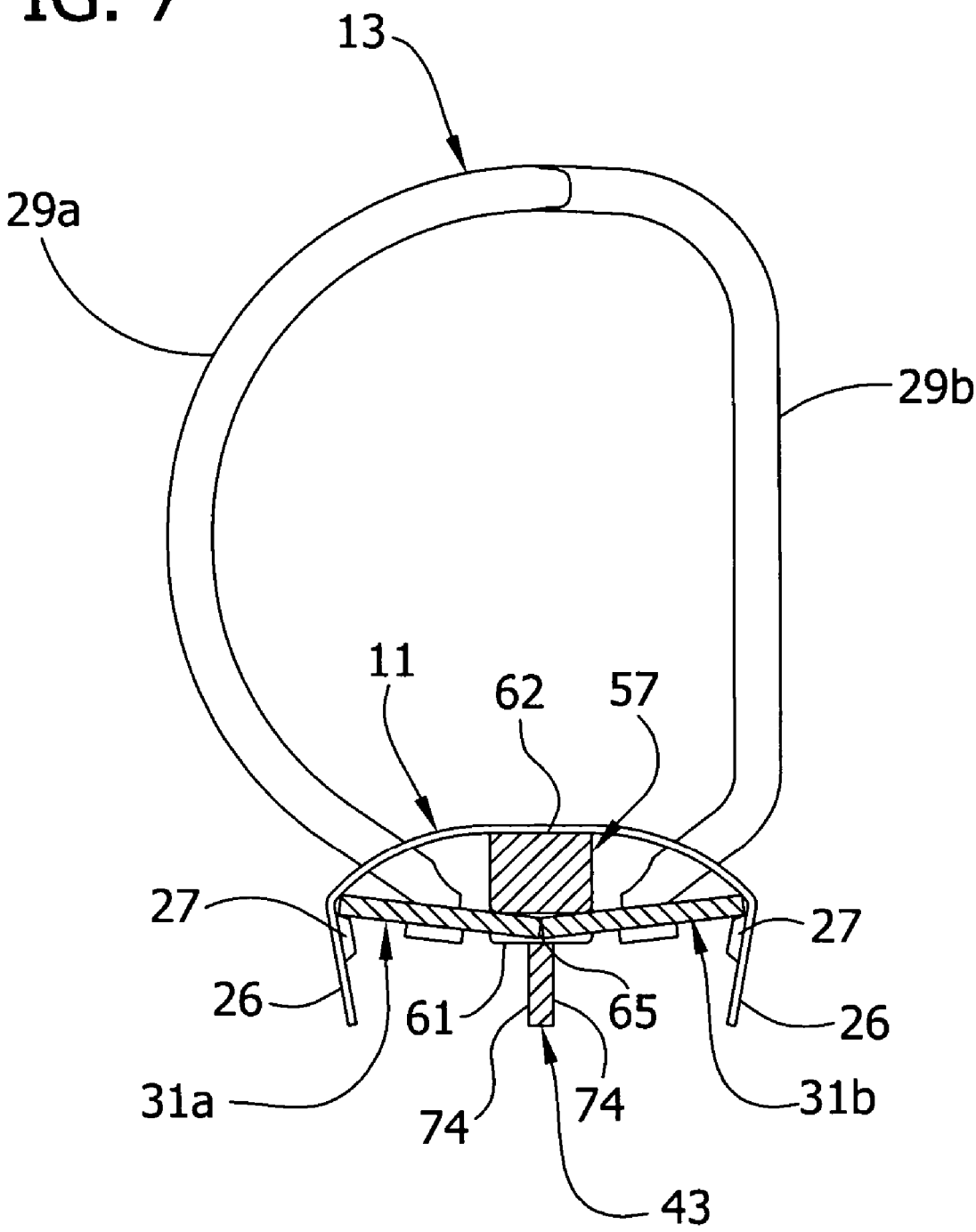
FIG. 7 is a section taken in the plane of line 7-7 of FIG. 6 with a spring of the mechanism removed.

Housing 11 also includes two opposite, lower bent rims 26 (only one rim is visible in FIG. 2), extending along a respective longitudinal edge margin of the housing. Each rim 26 includes nine circular indentations (broadly, "pivot supports"), each of which are designated by reference numeral 27 (FIGS. 7 and 10). The indentations are spaced lengthwise along housing 11 and are pressed into housing rims 26 in a suitable manner. Indentations 27 protrude into the free space within housing 11 and, as will be described in greater detail hereinafter, support opening and closing movement of rings 13. Indentations with shapes other than circular are within the scope of this invention.

Also shown in FIG. 2 are ring members 29*a*, 29*b* that form each of rings 13. Ring members 29*a* each have a roughly semi-circular, C-shaped profile, while ring members 29*b* each have a squared-off, half box-shaped profile. Together, the ring members 29*a*, 29*b* form what is known as a D-ring. It is envisioned that both ring members 29*a*, 29*b* are formed from a conventional, cylindrical rod of a suitable material such as steel. But ring members having different cross-sections or formed from different materials do not depart from the scope of the invention. In addition, a mechanism with more or less than four rings, or with rings that form a different shape when closed does not depart from the scope of this invention.

FIG. 2 shows ring members 29*a*, 29*b* mounted on two similar hinge plates designated generally by reference numerals 31*a*, 31*b*, respectively. The ring members are shown extending from upper surfaces of the hinge plates, but ring members extending from lower surfaces of hinge plates are within the scope of this invention. Ring members 29*a*, 29*b* are mounted on hinge plates 31*a*, 31*b* in a suitable manner. Although both ring members 29*a*, 29*b* move in illustrated mechanism 1, a mechanism having one movable ring member and one fixed does not depart from the scope of this invention (e.g., one ring member of each ring mounted on a hinge plate and one ring member mounted on a stationary housing).

Hinge plates 31*a*, 31*b* each have substantially the same shape. Each is thin, flat, and generally rectangular, and each includes five cutouts 33*a-e* and 35*a-e*, respectively, and two detents, each designated 37. Cutouts 33*a-e* are located in hinge plate 31*a* in spaced apart relation along an inner longitudinal edge margin of the hinge plate. Cutouts 35*a-e* are correspondingly located in hinge plate 31*b* along an inner longitudinal edge margin of the hinge plate. More particularly, cutouts 33*a*, 33*e* and cutouts 35*a*, 35*e* are located toward opposite longitudinal ends of respective hinge plates 31*a*, 31*b*. Cutouts 33*b-d* and cutouts 35*b-d* are located inward and between end cutouts 33*a*, 33*e* and end cutouts 35*a*, 35*e*, respectively, in generally uniform spaced relation. As will be described in regard to operation of ring mechanism 1, the cutouts accommodate control structure 15 to either allow the pivoting movement of hinge plates 31*a*, 31*b* or to block the pivoting movement.

The detents 37 are each located along an outer longitudinal edge margin of respective hinge plates 31*a*, 31*b* and are each recessed into the hinge plate. The detents 37 are each located toward a longitudinal end of respective hinge plate 31*a*, 31*b* so that the locations of the detents in hinge plate 31*a* correspond to the locations of the detents in hinge plate 31*b*. As will be described in regard to the assembled ring mechanism 1, detents 37 serve as a connection point to secure travel bar 43 to hinge plates 31*a*, 31*b*. Two coil springs, each designated generally by reference numeral 63, connect to detents 37 to thereby secure travel bar 43 adjacent hinge plates 31*a*, 31*b*.

Hinge plates 31*a*, 31*b* also each include a finger 39 extending longitudinally away from a rearward end the hinge plate. Each finger 39 is located adjacent a respective end cutout 33*a*, 35*a* and is somewhat narrower than the rest of the respective hinge plate 31*a*, 31*b*. An inner edge margin of each finger 39 aligns with the inner edge margin of its respective hinge plate 31*a*, 31*b*, and an end of the finger is bent slightly downward out of plane with the rest of the hinge plate. Fingers 39 are used in operation of ring mechanism 1 to interact with lever 19 of control structure 15 as will be described in greater detail hereinafter.

Figure 3:
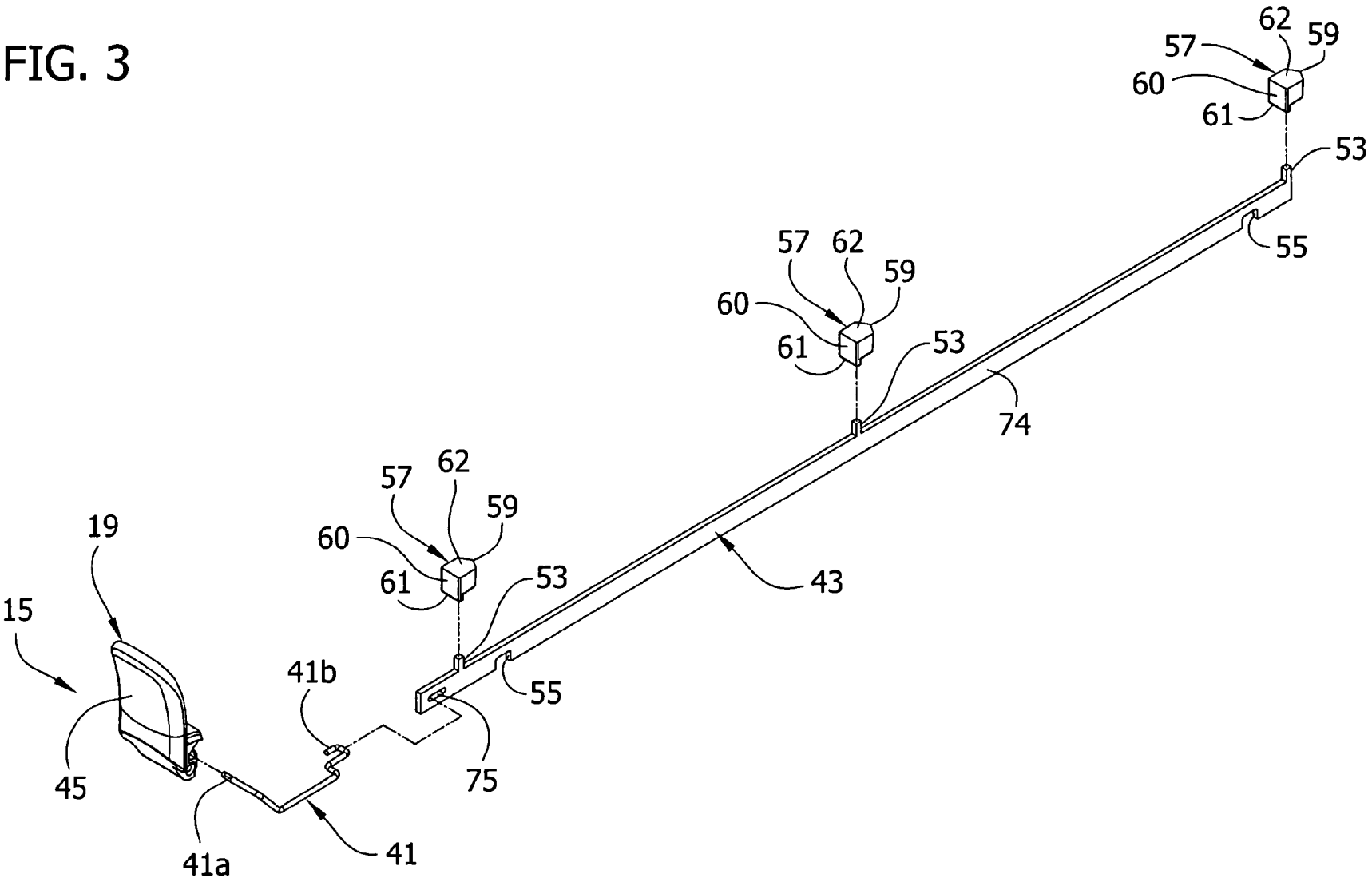
FIG. 3 is an exploded perspective of a control structure of the mechanism.
Figure 4:
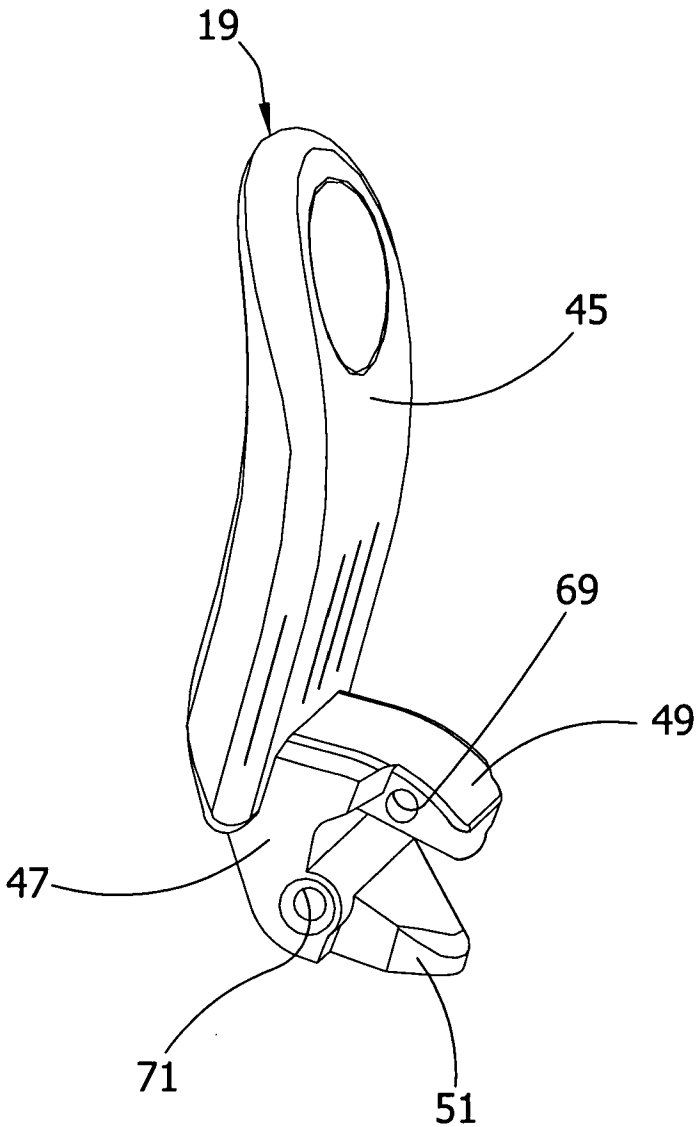
FIG. 4 is a perspective of the lever of the control structure.

Control structure 15 will now be described with reference to FIGS. 3 and 4. The control structure is best shown in FIG. 3 and includes lever 19, an intermediate connector, designated generally by reference numeral 41, and a travel bar, designated generally by reference numeral 43. As shown in FIG. 4, lever 19 is generally L-shaped with an enlarged head 45 and a roughly C-shaped base 47. Head 45 is curved at its top slightly rearward and facilitates gripping lever 19 to pivot it. Base 47 is connected to head 45 toward a bottom of the head and includes an upper closing arm 49 and a spaced apart lower opening arm 51. The closing and opening arms extend away from head 45 in generally perpendicular orientation to the head and in generally parallel relation to each other. In operation of ring mechanism 1, the arms receive hinge plate fingers 39 therebetween to pivot hinge plates 31*a*, 31*b* upward and downward.

Referring now to FIG. 3, travel bar 43 is elongate, flat, and lies generally in a vertical plane (as oriented in FIG. 3). It is envisioned that travel bar 43 is stamped from a sheet of material and is free of bends. An upper edge of travel bar 43 includes three vertical tabs, each designated by reference numeral 53, while a lower edge of the travel bar includes two cutouts, each designated by reference numeral 55. Tabs 53 are spaced apart along the upper edge of travel bar 43 with one tab located toward each longitudinal end of the travel bar and one located near a center of the travel bar. Cutouts 55 on the lower edge of travel bar 43 are located toward each longitudinal end and each spaced slightly inward of end tabs 53.

Travel bar 43 includes three similarly shaped locking elements, each designated generally by reference numeral 57. Each locking element is roughly wedge shaped and includes an angled forward end 59, a flat rearward end 60, and a broad upper surface 62. A thin neck 61 extends downward from rearward end 60 and, as will be described, serves to connect respective locking element 57 to travel bar 43. In illustrated mechanism 1, locking elements 57 are formed separately from travel bar 43. But a ring mechanism in which locking elements are integral with the travel bar does not depart from the scope of this invention.

Intermediate connector 41 is shown generally between lever 19 and travel bar 43. As will be described, it links lever 19 to travel bar 43 for operation of ring mechanism 1 to lock ring members 29*a*, 29*b* of closed rings 13 together. Intermediate connector 41 is generally C-shaped and is formed from a thin wire with free ends 41*a*, 41*b*. Rearward end 41*a* is generally straight while forward end 41*b* is generally hook shaped. End 41*a* is bent upward about 45° relative to end 41*b*, and both ends 41*a*, 41*b* are bent inward about 90°.

Assembled ring mechanism 1 will be described with reference to FIGS. 5-9. Housing 11 loosely supports hinge plates 31*a*, 31*b* in parallel, interconnected arrangement. Outer longitudinal edge margins of hinge plates 31*a*, 31*b* fit above indentations 27 of respective housing rims 28 for pivoting support within the housing 11, and inner longitudinal edge margins of the hinge plates engage at a central pivoting hinge 65. Cutouts 33*a-e* and 35*a-e* (FIG. 2) of respective hinge plates 31*a*, 31*b* align to form cutout openings 67*a-e* symmetrically aligned along hinge 65. Hinge plates 31*a*, 31*b* are oriented with their fingers 39 positioned toward the rearward, open end of housing 11. Ring members 29*a*, 29*b* extend from respective hinge plates 31*a*, 31*b* upward through housing 11 at respective ring openings 25 and engage each other above housing 11 to form closed rings 13.

Figure 8:
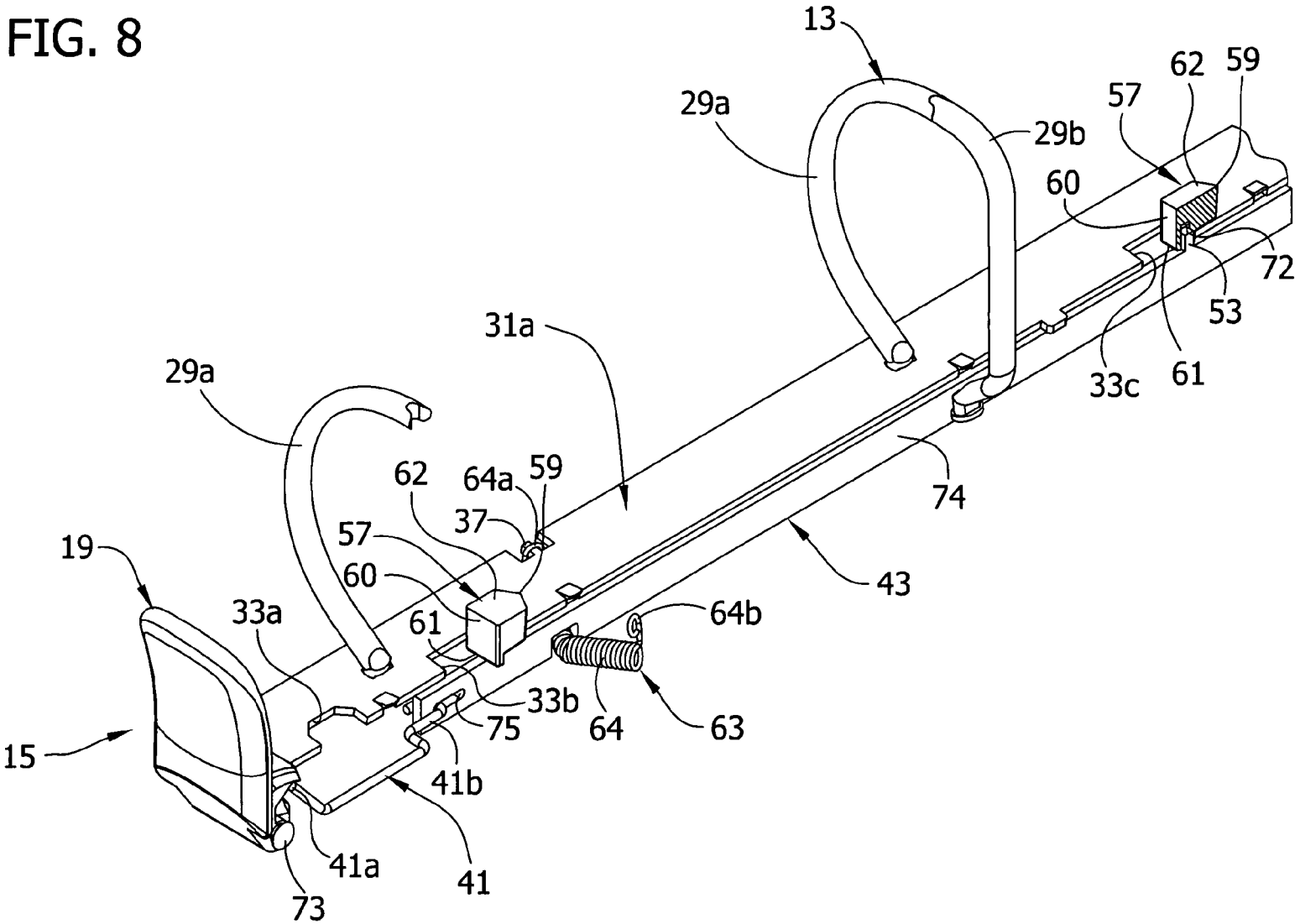
FIG. 8 is an enlarged and fragmentary perspective of the ring mechanism with components removed to show internal construction.
Figure 9:
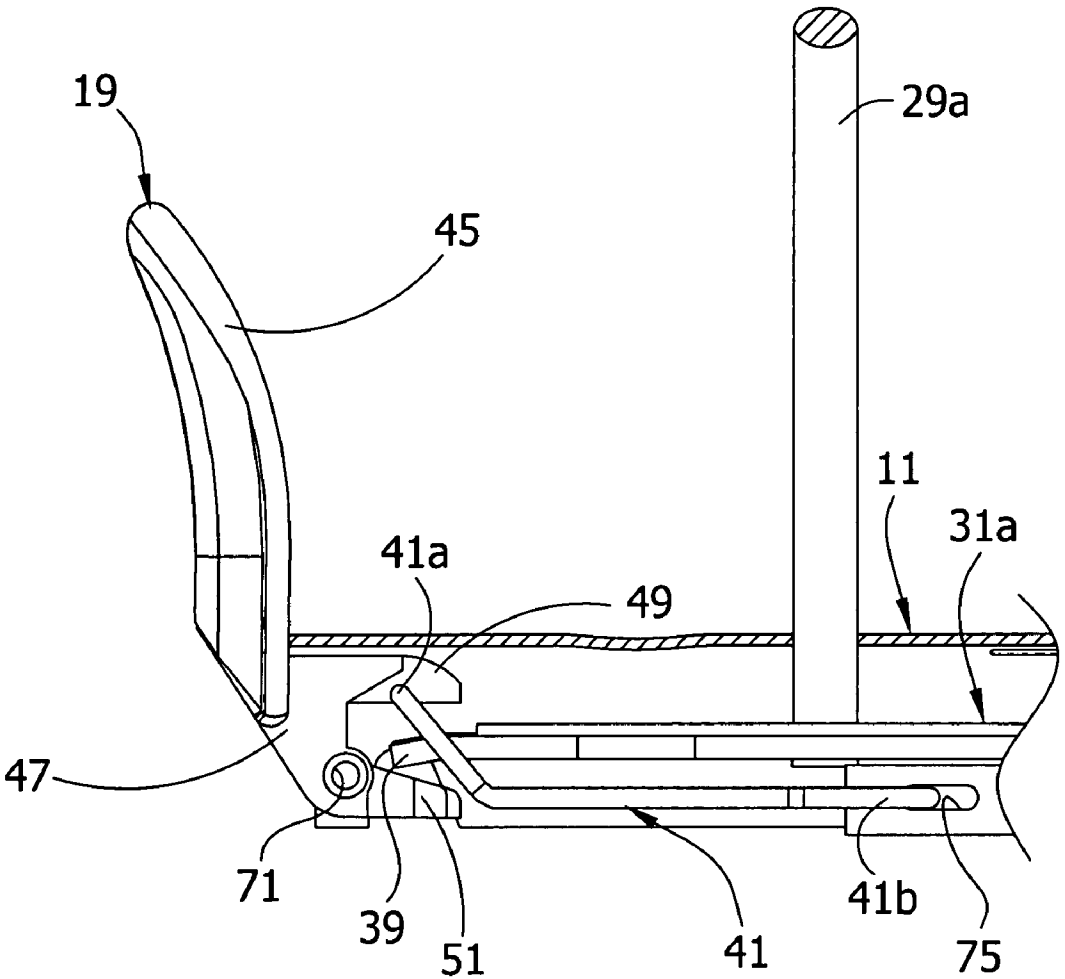
FIG. 9 is an enlarged and fragmentary side view of the ring mechanism with components broken away and removed to show internal construction.

As best shown in FIGS. 8 and 9, intermediate connector 41 connects to lever 19 at opening 69 (FIG. 4) in closing arm 49. Rearward end 41*a* of the connector pivotally fits in opening 69 for conjoint translational movement of intermediate connector 41 with lever 19. It is to be understood that lever 19 has two such openings 69 on opposite sides of closing arm 49, but only one is visible in the drawings. Intermediate connector 41 can connect to lever 19 at only one of the openings 69, but it could be either opening withing the scope of this invention.

As shown in FIG. 8, locking elements 57 each connect to travel bar 43 at respective tabs 53. An opening 72 in neck 61 of each locking element 57 is sized and shaped to fit over tab 53 to secure the locking element to the upper edge of travel bar 43.

Figure 5:
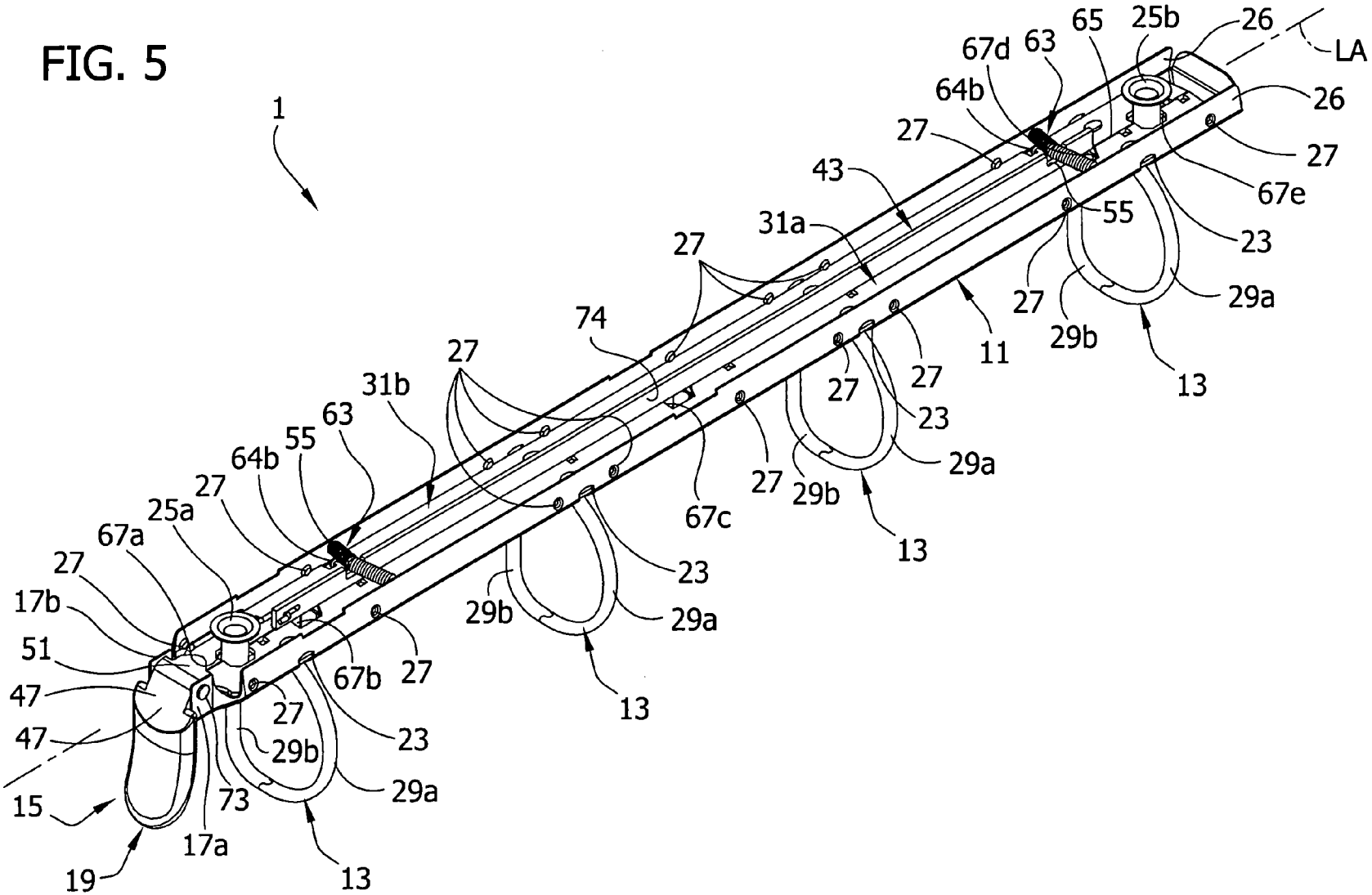
FIG. 5 is a bottom side perspective of the ring mechanism with ring members at a closed and locked position.
Figure 6:
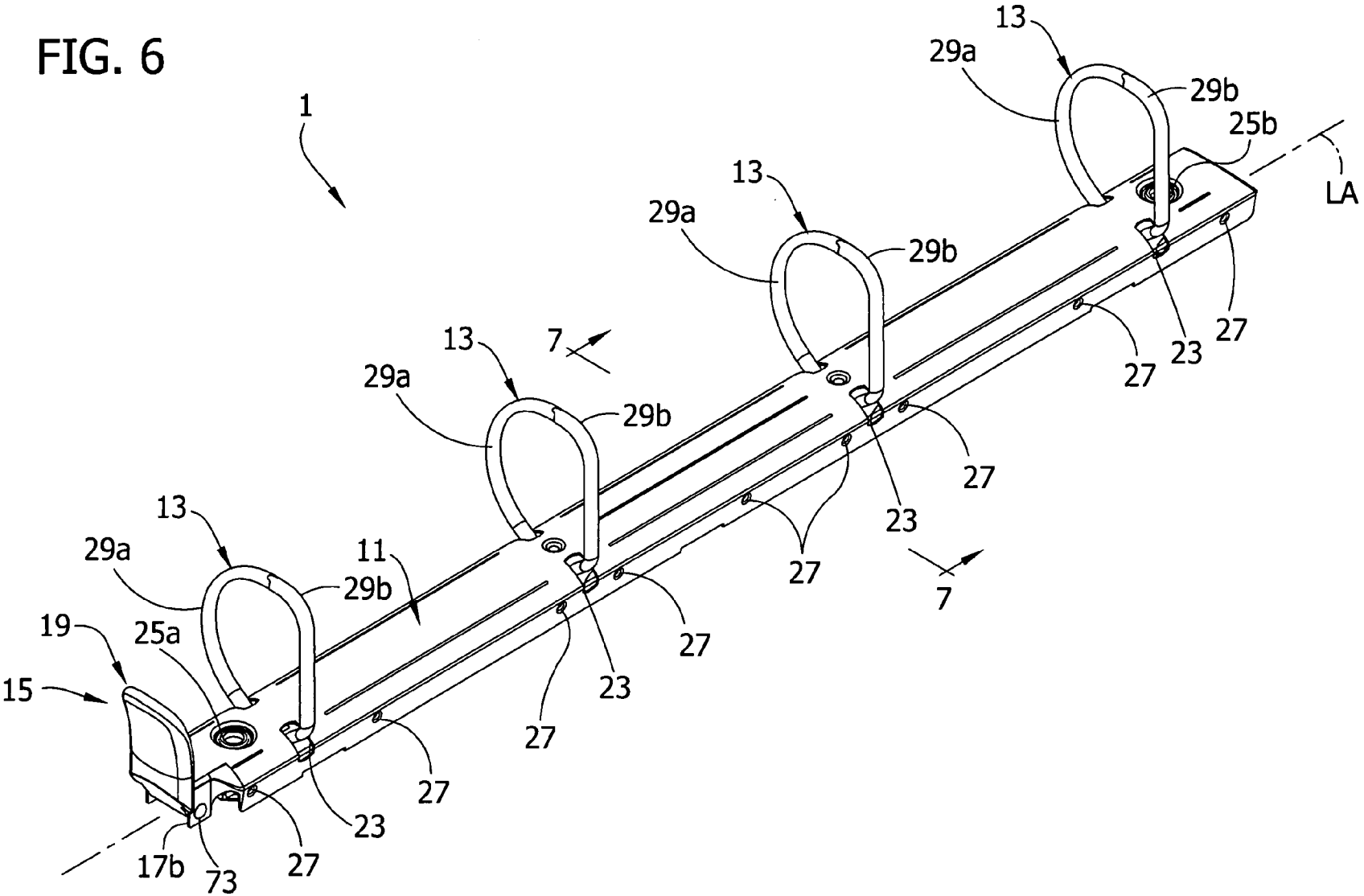
FIG. 6 is a top side perspective thereof.

Referring to FIGS. 5-7, lever 19 and intermediate connector 41 mount on the rearward end of housing 11 at mounting tabs 17*a*, 17*b*. An aperture 71 (FIG. 4) formed through lever base 47 adjacent opening arm 51 aligns with openings in mounting tabs 17*a*, 17*b*. A hinge pin 73 fits through the aperture and aligned openings to pivotally mount lever 19 and intermediate connector 41 on housing 11. In this mounted position, enlarged head 45 extends upward generally above housing 11, and closing arm 49 and opening arm 51 position above and below, respectively, fingers 39 of hinge plates 33*a*, 33*b*.

Travel bar 43 is disposed under hinge plates 31*a*, 31*b* in general alignment with hinge 65. A vertical plane containing travel bar 43 is oriented generally perpendicular to hinge plates 31*a*, 31*b* when in their co-planar position. The travel bar 43 has major surfaces 74 lying generally in a plane parallel to or coincident with a plane including a longitudinal axis LA of the housing 11 and the pivot axis, or hinge 65, of the hinge plates 31a, 31*b* (e.g., FIGS. 5 and 7). Stated another way, the major surfaces 74 of the travel bar 43 are generally parallel to a plane including the longitudinal axis LA of the housing 11 and passing through the central top portion of the housing and the open bottom of the housing. Locking elements 57 extend upward from travel bar tabs 53 through respective cutout openings 67*b-d* of hinge plates 31*a*, 31*b*. Locking elements 57 are positioned generally behind hinge plates 31*a*, 31*b* and above hinge 65. Neck 61 of each locking element 57 is adjacent a forward edge of respective cutout openings 67*b-d*. A bottom surface of each locking element 57 engages upper surfaces of hinge plates 31*a*, 31*b*, and the broad upper surface 62 of each locking element engages a lower surface of housing 11 (e.g., FIG. 7). In this position, locking elements 57 firmly oppose any force tending to pivot hinge plates 31*a*, 31*b* upward. The ring members 29*a*, 29*b* are securely locked in their closed position.

As shown in FIG. 3, forward end 41*b* of intermediate connector 41 connects to travel bar 43 at slot 75 in a rearward end of the travel bar. Slot 75 is elongated longitudinally of travel bar 43 to allow hook-shaped end 41*b* of intermediate connector 41 to easily pass through the slot and connect to the intermediate connector. The connection is secure enough for intermediate connector 41 to pull travel bar 43 toward lever 19, but still loose enough to allow the connector to pivot relative to the travel bar to accommodate small amounts of vertical movement of the connector occurring when the lever pivots and moves the connector.

As shown in FIG. 8, springs 63 are each connected to hinge plates 31*a*, 31*b* at corresponding detents 37. Spring ends 64*a*, 64*b* loop over corresponding tab-shaped detents 37 of hinge plates 31*a*, 31*b*, and coiled body 64 of each spring passes over travel bar 43, holding it adjacent the lower surfaces of the hinge plates. Springs 63 are flexible and can each bend about an axis transverse to the longitudinal axis of its coiled body 64. This allows them to curve slightly rearward when attached to hinge plates 31*a*, 31*b* and fit within one of respective cutouts 55. In this position, springs 63 are tensioned to urge travel bar 43 toward a forward position in which locking elements 57 seat against the forward edges of cutout openings 67*b-d*. The forward urge also holds hook-shaped end 41*b* of intermediate connector 41 against a rearward end of travel bar slot 75, preventing the two from disconnecting during operation.

As can be seen, springs 63 retain travel bar 43 on the ring mechanism 1. Coiled bodies 64 of springs 63 fit within respective cutouts 55 of the travel bar 43 and provide an upward force on the travel bar and its locking elements 57 to retain them on the mechanism 1. Specifically, the upward force holds the travel bar so that the broad upper surfaces 62 of the travel bar locking elements 57 engage the lower surface of the housing 11. This engagement is maintained during operation of the ring mechanism, which will be described shortly. The engagement of the surfaces 62 of the locking elements 57 helps to stabilize the travel bar 43 in the position with the major surfaces 74 oriented generally vertically (as oriented in the drawings).

Mounting posts 23*a*, 23*b* are attached to housing 11 at respective housing openings 21*a*, 21*b*. They extend downward and through cutout openings 67*a*, 67*e* of hinge plates 31*a*, 31*b*, allowing the hinge plates to pivot about hinge 65 relative to the posts without contacting them. Mounting post 23*a* additionally extends past intermediate connector 41, which is shaped to extend around the post. Thus intermediate connector 41 can move longitudinally of mounting post 23*a* without contacting it. Force is transmitted from lever 19, around post 23*a*, to travel bar 43 along a centerline of intermediate connector 41.

As can be seen from the description of the assembled ring mechanism 1, the hinge plates 31*a*, 31*b* are connected to the housing 11 before the travel bar 43 is installed. This beneficially simplifies manufacture of this mechanism 1.

Figure 11:
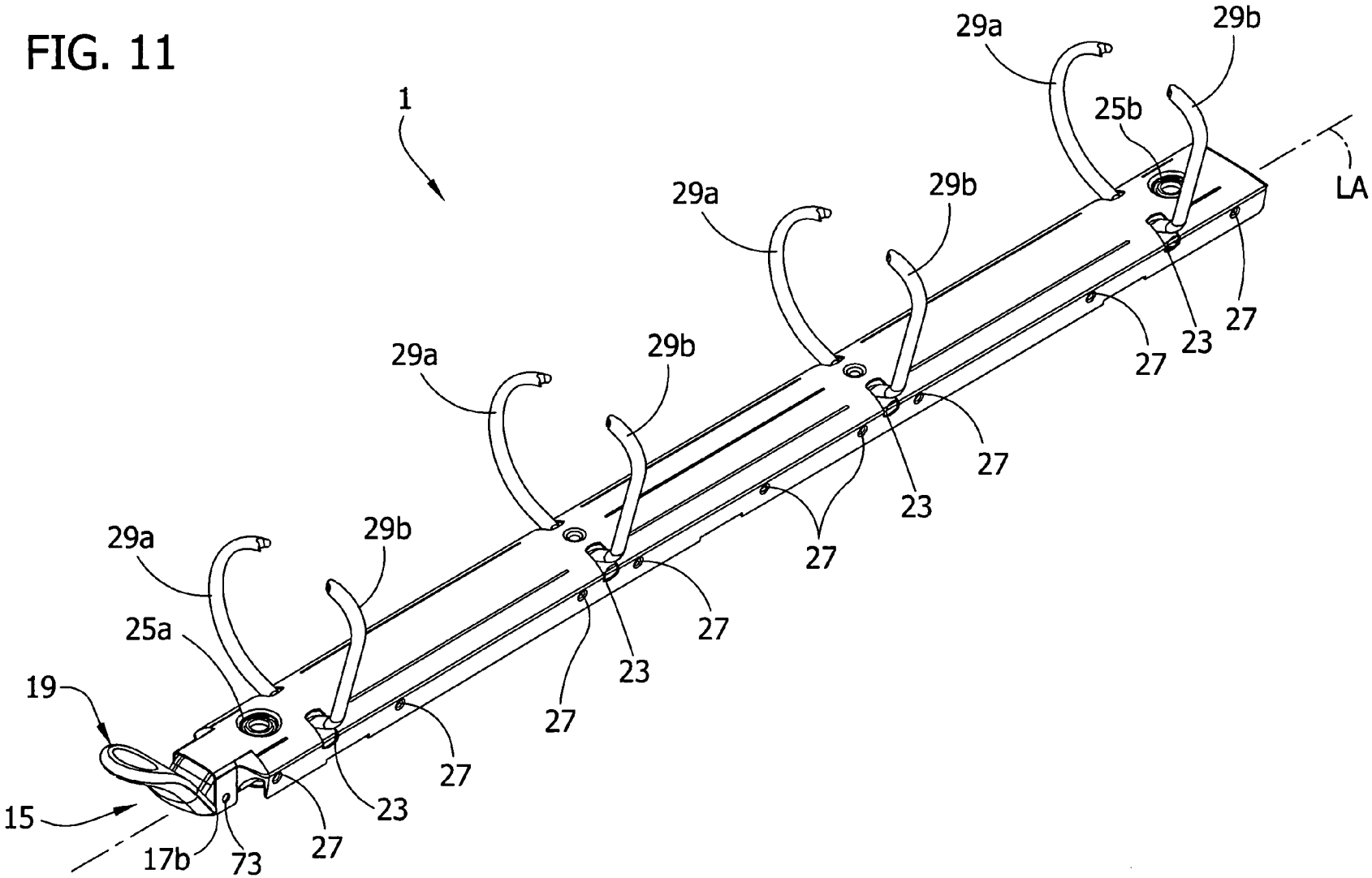
FIG. 11 is a top side perspective thereof.
Figure 12:
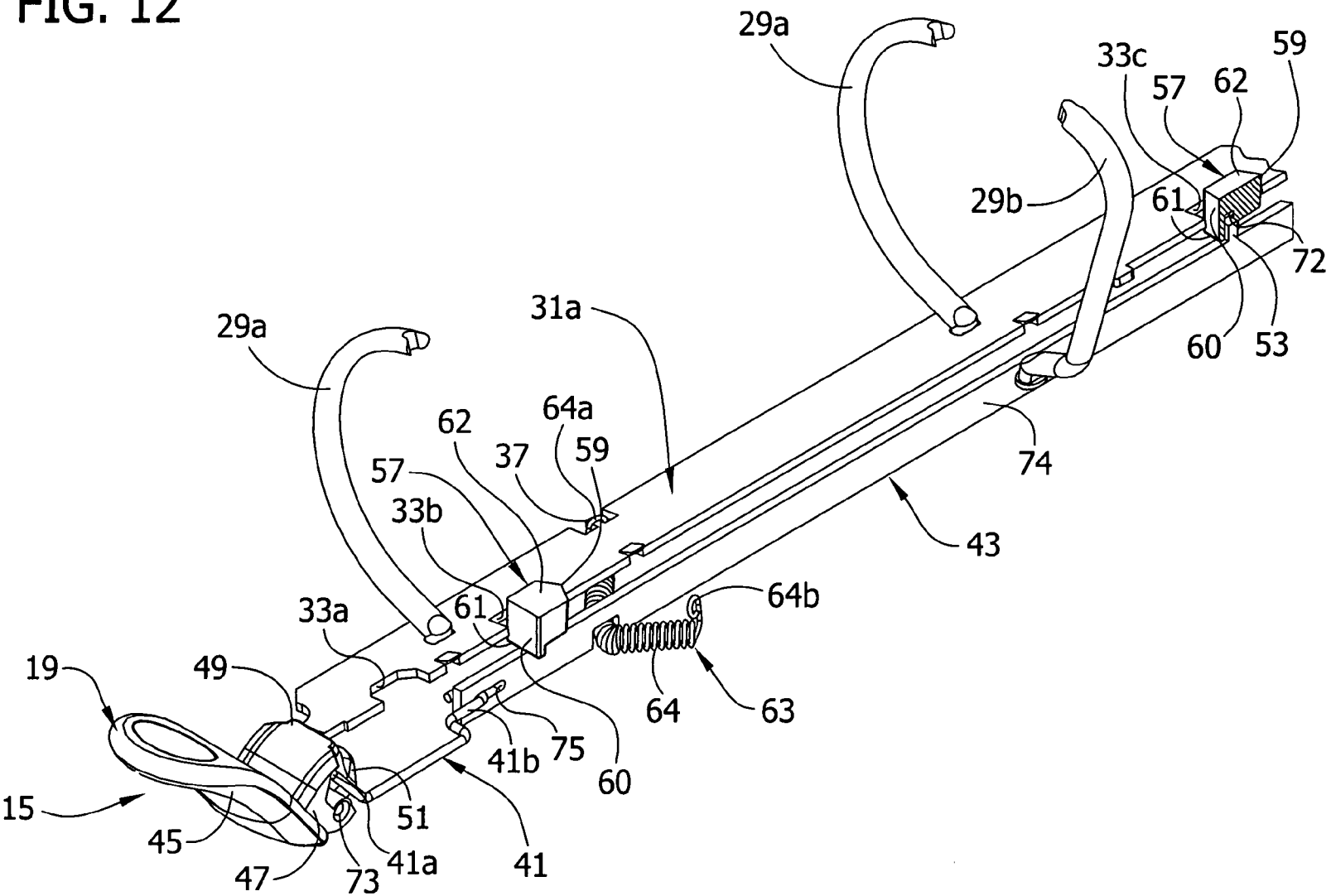
FIG. 12 is an enlarged and fragmentary perspective thereof with components removed to show internal construction.

Operation of ring mechanism 1 will now be described. FIGS. 1 and 5-9 illustrate the ring mechanism with ring members 29*a*, 29*b* in the closed and locked position, and FIGS. 10-12 illustrate it with the ring members in an open position. In operation of mechanism 1, as is generally known, hinge plates 31*a*, 31*b* pivot relative to housing 11 about hinge 65 upward and downward. Ring members 29*a*, 29*b* mounted on hinge plates 31*a*, 31*b* move with the pivoting movement of the hinge plates between the closed and open positions. Housing 11, which is slightly narrower than hinge plates 31*a*, 31*b* when in their co-planar position, provides a small spring force that biases the hinge plates to pivot fully downward or upward. Ring members 29*a*, 29*b* close when hinge plates 31*a*, 31*b* move downward and the ring members open when the hinge plates move upward.

As shown in FIGS. 5-7, when ring members 29*a*, 29*b* are closed and locked they form a continuous D-shaped loop, allowing loose-leaf pages to be retained by ring mechanism 1. Hinge plates 31*a*, 31*b* are supported by indentations 27 and are hinged fully downward, away from housing 11, and lever 19 is in a substantially vertical position. Travel bar 43 is located in a generally forward position under tension from springs 63 with locking elements 57 positioned between hinge plates 31*a*, 31*b* and housing 11, substantially out of registration with hinge plate cutout openings 67*b-d*. Lever opening arm 51 is spaced below and apart from hinge plate fingers 39, and lever closing arm 49 is spaced above and apart from the fingers.

To unlock mechanism 1 and open ring members 29*a*, 29*b*, lever 19 is pivoted outward and downward. This moves lever opening arm 51 upward toward hinge plate fingers 39 and pulls intermediate connector 41 rearward. Intermediate connector 41 in turn pulls travel bar 43 lengthwise of housing 11 in the same rearward direction toward lever 19 against the tension of springs 63. The locking elements 57 move with the travel bar 43 and the broad upper surfaces 62 of the locking elements slide along the lower surface of the housing 11. The springs 63 hold the surfaces 62 of the locking elements 57 against the lower surface of the housing 11 as the travel bar 43 moves. The travel bar movement causes the springs 63 to stretch and curve further rearward while locking elements 57 move into registration over hinge plate cutout openings 67*b-d*. At about this time, lever opening arm 51 engages hinge plate fingers 39 at hinge 65 and begins pivoting hinge plates 31*a*, 31*b* upward (the hinge plate pivoting is supported by indentations 27). The hinge plates deform housing 11 and produce the housing spring force that biases the hinge plates 33*a*, 33*b* fully upward. It can be seen that the spacing between opening arm 51 and hinge plate fingers 39 provides room for lever 19 to move travel bar 43 and locking elements 57 immediately and prior to opening arm 51 engaging and pivoting hinge plates 31*a*, 31*b*. This lost motion allows locking elements 57 to move into registration over respective hinge plate cutout openings 67*b-d* before hinge plates 31*a*, 31*b* pivot upward. Locking elements 57 do not impede the pivoting movement of hinge plates to open ring members 29*a*, 29*b* . It is only after locking elements 57 register over respective openings 67*b-d* that opening arm 51 pushes the hinge plates upward. The broad upper surfaces 62 of the locking elements 57 always remain in contact with the lower surface of the housing 11.

Once hinge plates 31*a*, 31*b* pivot fully upward and ring members 29*a*, 29*b* open (FIGS. 9-12), lever 15 can be released. The tension in springs 63 recoil and slightly urge travel bar 43 forward. Angled forward ends 59 of locking elements 57 move into engagement with forward edges of respective hinge plate cutout openings 67*b-d* and lever closing arm 49 moves into engagement with upper surfaces of hinge plates 31*a*, 31*b*. But springs 63 are not strong enough to urge control structure 15 to pivot hinge plates 31*a*, 31*b* downward through their co-planar position. Ring members 29*a*, 29*b* are held in the open position, forming a discontinuous, open loop for adding or removing loose-leaf pages from the ring members.

To close ring members 29*a*, 29*b* and lock mechanism 1, lever 19 can be pivoted upward and inward or ring members 29*a*, 29*b* can be pushed together. Pivoting lever 19 causes lever closing arm 49 to push hinge plates 31*a*, 31*b* downward and simultaneously causes intermediate connector 41 to push travel bar 43 and locking elements 57 forward. Once hinge plates 31*a*, 31*b* pass through their coplanar position, the housing spring force biases them fully downward over locking elements 57. The tension from springs 63 pulls travel bar 43 to its forward position so that locking element necks 61 bear against forward edges of hinge plates 31*a*, 31*b*. The springs 63 pull lever 19 to its vertical position and move locking elements 57 to their blocking position behind hinge plates 31*a*, 31*b*.

Pushing ring members 29*a*, 29*b* together also closes them. This directly pivots hinge plates 31*a*, 31*b* downward. The hinge plates slide along angled forward edges of locking elements 57 until the housing spring force biases them fully downward. At about the same time, hinge plate fingers 39 engage lever opening arm 51 and pivot lever 19 upward and inward and springs 63 pull travel bar 43 forward. Lever 19 is moved to its vertical position by travel bar 43 and locking elements 57 move to their blocking position behind hinge plates 31*a*, 31*b*.

It is understood that as the travel bar 43 moves lengthwise of the housing 11, the broad upper surfaces 62 of the locking elements 57 remain in contact with the lower surface of the housing 11. Thus, when the hinge plates 31*a*, 31*b* pivot upward to open the ring members 29*a*, 29*b* or downward to close the ring members, the travel bar 43 does not move with the plates. The locking elements 57 engaging the housing hold the travel bar 43 against vertical movement relative to the hinge plates 31*a*, 31*b* and housing 11 during each of these operations.

Components of ring binder mechanism 1 of the invention are made of a suitable rigid material, such as a metal (e.g. steel). But mechanisms having components made of a non-metallic material, specifically including a plastic, do not depart from the scope of this invention.

When introducing elements of the invention, the articles "a", "an", "the" and "said" are intended to mean that there are one or more of the elements. The terms "comprising", "including" and "having," and variations thereof, are intended to be inclusive and mean that there may be additional elements other than the listed elements. Moreover, the use of "up", "down", "vertical", "horizontal", and variations of these terms is made for convenience, but does not require any particular orientation of the components.

As various changes could be made in the above without departing from the scope of the invention, it is intended that all matter contained in the above description and shown in the accompanying drawings shall be interpreted as illustrative and not in a limiting sense.

What is claimed is:

1. A ring mechanism for retaining loose-leaf pages, the mechanism comprising:

a housing having a longitudinal axis, a central top portion and an open bottom generally opposed to the central top portion;

hinge plates each having an upper surface and a lower surface, the hinge plates being supported by the housing for pivoting movement relative to the housing with an upper surface of each hinge plate facing the housing;

rings for holding loose-leaf pages, each ring including a first ring member and a second ring member, the first ring member being mounted on a first hinge plate and moveable with the pivoting motion of the first hinge plate relative to the second ring member between a closed position and an open position, in the closed position the two ring members forming a substantially continuous, closed loop for allowing loose-leaf pages retained by the rings to be moved along the rings from one ring member to the other, and in the open position the two ring members forming a discontinuous, open loop for adding or removing loose-leaf pages from the rings;

a thin, flat travel bar supported for movement between a locked position in which the hinge plates are locked from pivoting from the closed position to the open position and an unlocked position in which the hinge plates are free to pivot from the closed position to the open position, the travel bar including a major surface lying generally in a plane parallel to or co-planar with a plane including the longitudinal axis of the housing, the plane including the major surface of the travel bar intersecting the central top portion and open bottom of the housing; and at least one locking element mounted on the travel bar for movement therewith, the locking element being adapted to block movement of the hinge plates in the locked position of the travel bar, wherein the travel bar is formed by a piece of sheet material and is free of bends, and the locking element engages an upper surface of at least one of the hinge plates when the travel bar is in the locked position.

2. A ring mechanism as set forth in claim 1 further comprising a spring for retaining the travel bar on the ring mechanism.

3. A ring mechanism as set forth in claim 1 wherein the locking element includes a broad upper surface engaging a lower surface of the housing for stabilizing the travel bar.

4. A ring mechanism as set forth in claim 1 wherein said at least one hinge plate includes an opening, the locking element extending from the travel bar through the opening to engage the upper surface of the hinge plate.

5. A ring mechanism as set forth in claim 1 further comprising a lever and a connector, the connector being operatively connected to the lever and to the travel bar for connecting the lever to the travel bar so that pivoting motion of the lever produces translational movement of the travel bar, the connector and travel bar being located underneath the hinge plates.

6. A ring mechanism as set forth in claim 1 in combination with a cover, the ring mechanism being mounted on the cover, the cover being hinged for movement to selectively cover and expose loose-leaf pages retained on the ring mechanism.

7. A ring mechanism for retaining loose-leaf pages, the mechanism comprising:

a housing;

hinge plates each having an upper surface and a lower surface, the hinge plates being supported by the housing for pivoting movement relative to the housing about a pivot axis with an upper surface of each hinge plate facing the housing;

rings for holding loose-leaf pages, each ring including a first ring member and a second ring member, the first ring member being mounted on a first hinge plate and moveable with the pivoting motion of the first hinge plate relative to the second ring member between a closed position and an open position, in the closed position the two ring members forming a substantially continuous, closed loop for allowing loose-leaf pages retained by the rings to be moved along the rings from one ring member to the other, and in the open position the two ring members forming a discontinuous, open loop for adding or removing loose-leaf pages from the rings;

a travel bar disposed generally below the hinge plates, the travel bar being supported for movement between a locked position in which the travel bar blocks movement of the hinge plates from the closed position to the open position and an unlocked position in which the travel bar does not block movement of the hinge plates from the closed position to the open position; and at least two coil springs connected to the hinge plates and supporting the travel bar in a position adjacent a lower surface of at least one of the hinge plates, wherein the springs extend generally transversely of the travel bar and wherein the travel bar includes a cutout for each coil spring, each coil spring passing through a respective one of the cutouts to support the travel bar in the position adjacent the lower surface of at least one of the hinge plates.

8. A ring mechanism as set forth in claim 7 wherein the coil spring biases the travel bar toward the locked position.

9. A ring mechanism as set forth in claim 7 wherein the travel bar is supported against the lower surface of at least one of the hinge plates by the coil springs.

10. A ring mechanism as set forth in claim 7 wherein each of said at least two coil springs includes two ends, a first end of the respective coil spring connecting to a first hinge plate and a second end connecting to a second hinge plate with each of said at least two coil springs extending across the travel bar to support the travel bar in the position adjacent the lower surface of at least one of the hinge plates.

11. A ring mechanism as set forth in claim 10 wherein the travel bar is flat, the travel bar having a major surface lying generally in a plane parallel to or coincident with a plane including a longitudinal axis of the housing and the pivot axis of the hinge plates.

12. A ring mechanism for retaining loose-leaf pages, the mechanism comprising:

a housing having a longitudinal axis, a central top portion and an open bottom generally opposed to the central top portion;

hinge plates each having an upper surface and a lower surface, the hinge plates being supported by the housing for pivoting movement relative to the housing with an upper surface of each hinge plate facing the housing;

rings for holding loose-leaf pages, each ring including a first ring member and a second ring member, the first ring member being mounted on a first hinge plate and moveable with the pivoting motion of the first hinge plate relative to the second ring member between a closed position and an open position, in the closed position the two ring members forming a substantially continuous, closed loop for allowing loose-leaf pages retained by the rings to be moved along the rings from one ring member to the other, and in the open position the two ring members forming a discontinuous, open loop for adding or removing loose-leaf pages from the rings;

a thin, flat travel bar supported for movement between a locked position in which the hinge plates are locked from pivoting from the closed position to the open position and an unlocked position in which the hinge plates are free to pivot from the closed position to the open position, the travel bar including a major surface lying generally in a plane parallel to or co-planar with a plane including the longitudinal axis of the housing, the plane including the major surface of the travel bar intersecting the central top portion and open bottom of the housing; and at least one locking element mounted on the travel bar for movement therewith, the locking element being adapted to block movement of the hinge plates in the locked position of the travel bar, the locking element including a broad upper surface engaging a lower surface of the housing for stabilizing the travel bar, wherein the travel bar is formed by a piece of sheet material and is free of bends.

13. A ring mechanism as set forth in claim 12 further comprising a lever and a connector, the connector being operatively connected to the lever and to the travel bar for connecting the lever to the travel bar so that pivoting motion of the lever produces translational movement of the travel bar, the connector and travel bar being located underneath the hinge plates.

14. A ring mechanism for retaining loose-leaf pages, the mechanism comprising:

a housing;

hinge plates each having an upper surface and a lower surface, the hinge plates being supported by the housing for pivoting movement relative to the housing about a pivot axis with an upper surface of each hinge plate facing the housing;

rings for holding loose-leaf pages, each ring including a first ring member and a second ring member, the first ring member being mounted on a first hinge plate and moveable with the pivoting motion of the first hinge plate relative to the second ring member between a closed position and an open position, in the closed position the two ring members forming a substantially continuous, closed loop for allowing loose-leaf pages retained by the rings to be moved along the rings from one ring member to the other, and in the open position the two ring members forming a discontinuous, open loop for adding or removing loose-leaf pages from the rings;

a travel bar disposed generally below the hinge plates, the travel bar being supported for movement between a locked position in which the travel bar blocks movement of the hinge plates from the closed position to the open position and an unlocked position in which the travel bar does not block movement of the hinge plates from the closed position to the open position; and a coil spring connected to the hinge plates and supporting the travel bar in a position adjacent a lower surface of at least one of the hinge plates, wherein the spring extends generally transversely of the travel bar and wherein the spring includes at least two ends, a first end of the coil spring connecting to a first hinge plate and a second end connecting to a second hinge plate with the coil spring extending across the travel bar to support the travel bar in the position adjacent the lower surface of at least one of the hinge plates.

15. A ring mechanism as set forth in claim 10 wherein the travel bar is flat, the travel bar having a major surface lying generally in a plane parallel to or coincident with a plane including a longitudinal axis of the housing and the pivot axis of the hinge plates.

* * * * *

UNITED STATES PATENT AND TRADEMARK OFFICE

CERTIFICATE OF CORRECTION

PATENT NO. : 7,665,926 B2
APPLICATION NO. : 11/157622
DATED : February 23, 2010
INVENTOR(S) : Ho Ping Cheng It is certified that error appears in the above-identified patent and that said Letters Patent is hereby corrected as shown below:

On the Title Page of the patent, Item (54), Title:

"RING MECHANISM WITH SPRING BIASED TRAVEL BAR"

should read

-- RING MECHANISM WITH TRAVEL BAR --.

In the Specifications:

In Column 1, Line 1 Title should read

-- RING MECHANISM WITH TRAVEL BAR --.

Signed and Sealed this

Twenty-sixth Day of October, 2010

David J. Kappos

David J. Kappos
*Director of the United States Patent and Trademark Office*

UNITED STATES PATENT AND TRADEMARK OFFICE

CERTIFICATE OF CORRECTION

PATENT NO. : 7,665,926 B2
APPLICATION NO. : 11/157622
DATED : February 23, 2010
INVENTOR(S) : Ho Ping Cheng It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 1045 days.

Signed and Sealed this

Seventh Day of December, 2010

David J. Kappos

David J. Kappos
*Director of the United States Patent and Trademark Office*